US007821354B2

(12) United States Patent
Niiranen

(10) Patent No.: US 7,821,354 B2
(45) Date of Patent: Oct. 26, 2010

(54) DIRECTIONAL COUPLER

(75) Inventor: Erkki Niiranen, Ii (FI)

(73) Assignee: Powerwave Comtek Oy, Kempele (FI)

( * ) Notice: Subject to any disclaimer, the term of this patent is extended or adjusted under 35 U.S.C. 154(b) by 146 days.

(21) Appl. No.: 12/300,316

(22) PCT Filed: Apr. 23, 2007

(86) PCT No.: PCT/FI2007/050216

§ 371 (c)(1),
(2), (4) Date: Nov. 10, 2008

(87) PCT Pub. No.: WO2007/132061

PCT Pub. Date: Nov. 22, 2007

(65) Prior Publication Data

US 2009/0146758 A1 Jun. 11, 2009

(30) Foreign Application Priority Data

May 12, 2006 (FI) ..... 20065317

(51) Int. Cl.
*H01P 5/18* (2006.01)
*H01P 3/08* (2006.01)

(52) U.S. Cl. ..... 333/116; 333/238; 333/246

(58) Field of Classification Search ..... 333/109, 333/110, 111, 112, 113, 115, 116, 238
See application file for complete search history.

(56) References Cited

U.S. PATENT DOCUMENTS 4,894,627 A 1/1990 Kane (Continued)

FOREIGN PATENT DOCUMENTS

FI 20040450 9/2005

(Continued)

OTHER PUBLICATIONS

European Patent Office Communication pursuant to Article 94(3) EPC pertaining to Application 07 730 703.1-1248 dated Jun. 30, 2010.

*Primary Examiner*—Dean O Takaoka
(74) *Attorney, Agent, or Firm*—OC Patent Law Group

(57) ABSTRACT

A directional coupler (500), which comprises a dielectric substrate (501) on top of a metal plate (510), is functioning as a ground plane. The transmission path is a suspended stripling so that there is a recess on the ground plane below the transmission conductor (520) being on the surface of the substrate. The sensing conductor (530) is a very small-sized conductive strip on the surface of the substrate. It has been connected from its head end to the measurement port (P3) and from its tail end via a termination resistor (550) to a small ground strip (515). The ground strip is next to the sensing conductor on the side of the output port (P2) of the directional coupler. With such an asymmetric structure, some directivity is obtained despite the small size of the sensing conductor. Also below the sensing conductor (530) there is a recess (506) on the ground plane, which joins the recess below the transmission conductor (520). By dimensioning the recess below the sensing conductor suitably, the velocities of the even and odd waveform occurring in the line constituted by it and the ground plane are obtained the same and thus directivity can be improved. The directional coupler is very space saving on the circuit board. As the substrate, an ordinary circuit board material can be used, whereby the board can have in addition to the directional coupler also other parts of radio-frequency circuits. The directional coupler does not require tuning in production.

13 Claims, 5 Drawing Sheets

U.S. PATENT DOCUMENTS

| | | | | |
|---|---|---|---|---|
| 5,012,209 | A | 4/1991 | Lantagne et al. | |
| 5,111,165 | A | 5/1992 | Oldfield | |
| 5,666,090 | A * | 9/1997 | Tsuruoka | 333/116 |
| 6,323,741 | B1 | 11/2001 | Kim et al. | |
| 6,822,532 | B2 | 11/2004 | Kane et al. | |
| 7,109,830 | B2 * | 9/2006 | Sweeney et al. | 333/246 |
| 7,400,214 | B2 * | 7/2008 | Storniolo et al. | 333/116 |
| 7,567,146 | B2 * | 7/2009 | Tervo | 333/112 |
| 2004/0160291 | A1 | 8/2004 | Antkowiak et al. | |
| 2006/0028295 | A1 | 2/2006 | Piernas | |
| 2006/0044075 | A1 | 3/2006 | Storniolo et al. | |

FOREIGN PATENT DOCUMENTS

| | | |
|---|---|---|
| FR | 2665579 | 2/1992 |
| GB | 2295928 | 6/1996 |
| WO | WO-9933139 | 7/1999 |
| WO | WO-2005093896 | 10/2005 |

* cited by examiner

DIRECTIONAL COUPLER

CROSS REFERENCE TO PRIOR APPLICATIONS

This is a U.S. National Phase application under 35 U.S.C. §371 of International Patent Application No. PCT/FI2007/050216, filed Apr. 23, 2007, and claims the benefit of Finnish Patent Application No. 20065317, filed May 12, 2006 both of which are incorporated by reference herein. The International Application published in English on Nov. 22, 2007 as WO 2007/132061 under PCT Article 21(2).

The invention relates to a directional coupler used in radio-frequency circuits.

The directional coupler is an arrangement related to the transmission path of a radio frequency electromagnetic field. It gives a measurement signal the level of which is proportional to the strength of a field propagating to a particular direction in the transmission path. In principle, a field propagating to the opposite direction in the transmission path does not affect the level of the measurement signal. The directional coupler has at least three ports: an input, an output and a measurement port. The energy of a signal incoming to the input port is led almost entirely through the coupler to the output port, and a small part of this energy is transferred to the measurement port. The part of the directional coupler between the input and output ports is at the same time a part of the transmission path of a radio apparatus which continues e.g. to the antenna of a transmitter. A measurement signal proportional to the actual strength of the field propagating towards the antenna is then received from the measurement port, which signal can be used in the adjusting purposes of the transmitter. The accuracy of the adjustment is partly dependent on the quality of the directional coupler, i.e., of how completely the effect of the field propagating in the opposite direction in respect of the field to be measured will be eliminated.

In this description and claims, the "forward signal/field" means the signal/field propagating from the input port to the output port of the directional coupler and the "reverse signal/field" means the signal/field propagating from the output port to the input port of the directional coupler.

Figure 1:
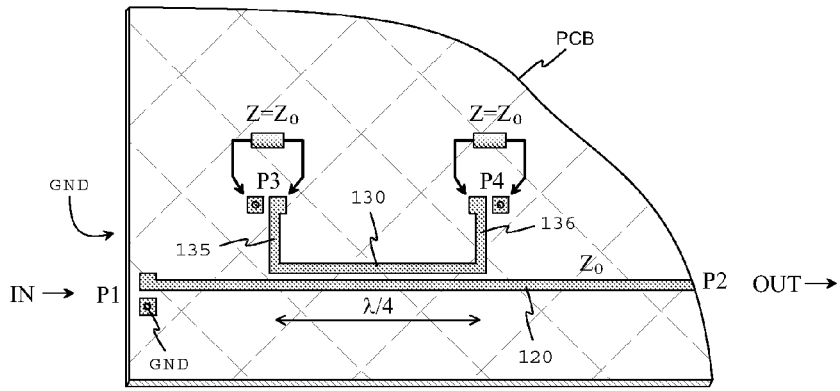
Fig. 1 PRIOR ART

A directional coupler can be designed in several ways. Most of them are based on utilising transmission lines of quarter-wave length. FIG. 1 shows an example of such a known directional coupler. In it, the transmission path of the signal to be measured comprises the transmission conductor 120 which is a conductive strip on the upper surface of a circuit board PCB, and the signal ground GND which is constituted of the conductive lower surface of the circuit board. The head end of the transmission conductor 120 together with a local signal ground constitute the input port P1 of the directional coupler. Correspondingly, the tail end of the transmission conductor together with the signal ground constitute the output port P2 of the directional coupler. In addition, on the upper surface of the circuit board PCB there is a second conductive strip 130 parallel to the transmission conductor the length of which strip is a quarter of wavelength $\lambda$ at the operating frequencies of the directional coupler. The distance between the conductive strips 120 and 130 is e.g. a tenth of their distance from the ground. The second conductive strip 130 continues at its ends away from the transmission conductor. The first continuation 135 ends at a third port, or a measurement port P3. When the directional coupler is in use, to the measurement port has been coupled a circuit the impedance Z of which is equal to the characteristic impedance $Z_o$ of the transmission lines constituted by the conductive strips of the directional coupler together with the signal ground and the medium. The second continuation 136 of the second conductive strip ends at the fourth port P4 which is also called the isolated port here. Thus, the directional coupler of the example has four ports, as do also most other directional couplers.

The second conductive strip 130 acts as a sensing conductor: because of the electromagnetic coupling between it and the transmission conductor, part of the energy fed to the input port transfers to the circuit of the sensing conductor, to the load impedances of the ports P3 and P4. When the frequency of the forward field is such that the $\lambda/4$ condition aforementioned and designated in FIG. 1 is fulfilled, the energy transferring to the measurement port P3 is at its maximum, and the energy transferring to the isolated port P4 at its minimum. The latter energy is zero in an ideal coupler, because even and odd waveforms occurring in the coupler cancel out each other at the end of the isolated port of the transmission line based on the sensing conductor 130. The directivity of the coupler is based on this fact. Namely, if a reverse field of equal frequency exists in the directional coupler, almost none of its energy is transferred to the measurement port P3 because of the symmetrical structure. The quality of directivity is expressed as the proportion of the signal level in the measurement port to the signal level in the isolated port. This is the same thing as the proportion of the signal level caused by the forward field in the measurement port to the signal level caused by the reverse field in the measurement port, when these fields propagating to opposite directions are of equal frequency and strength.

Figure 2:
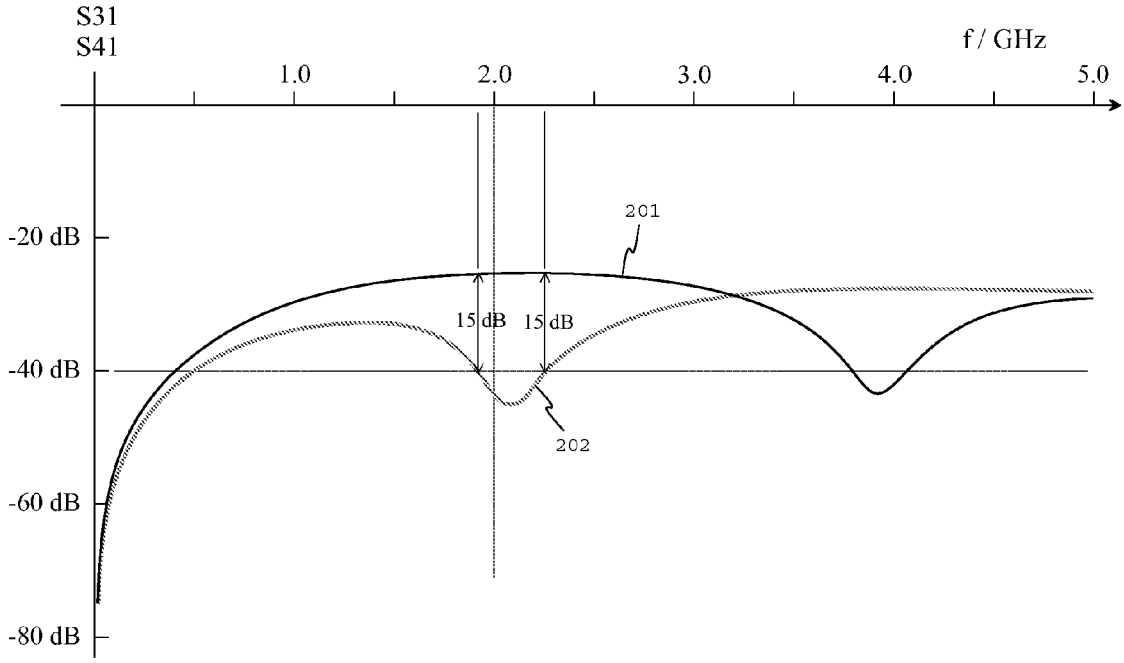
Fig. 2 PRIOR ART

FIG. 2 shows an example of the directivity and bandwidth of the directional coupler according to FIG. 1. The figure shows the curves of two transmission coefficients as the function of frequency. Curve 201 shows the change of the signal level in the measurement port in proportion to the level in the input signal, and curve 202 shows the change of the signal level in the isolated port in proportion to the level of the input signal. The difference of coefficients expressed in decibels indicates the value of directivity. It appears from the curves that directivity is at its highest around 20 dB which value is only valid in a frequency range the relative width of which is only a few percentages on both sides of frequency 2.08 GHz corresponding to the quarter wave. Directivity exceeds the value of 15 dB in the range of 1.92-2.25 GHz the relative width of which is around 16%. Curve 201 also indicates that, in the operating range of the directional coupler, the signal level in the measurement port is around 25 dB lower than the level of the signal propagating through the coupler. This means that the measurement signal causes an attenuation of 0.014 dB to the through-propagating signal.

If the directional coupler is used at a frequency in which the length of the parallel portions of the conductive strips 120 and 130 corresponds to a half wavelength, the situation in the third and the fourth port is reversed: the energy transferring to the third port P3 is at its minimum, and the energy transferring to the fourth port P4 is at its maximum. Again, if the directional coupler is used at frequencies which are low compared to the frequency corresponding to the length of the quarter wave, directivity is very low.

The aforementioned value of directivity, 20 dB, typical of directional couplers according to FIG. 1, is still unsatisfactory. This relatively modest value is caused by the even and odd waveform not entirely cancelling out each other on the side of the isolated port, because the odd waveform also propagates in addition to a dielectric medium to a greater extent in air, in which case its velocity is greater. A better structure by its directivity is obtained if both the transmission conductor and the sensing conductor are arranged inside a dielectric board, and both above and below these conductors there is a ground plane. An improvement is known from patent publication U.S. Pat. No. 6,549,089 in which inductance is suitably added between both the transmission and sensing conductor and the ground. This can be performed with coils or short-circuited transmission line branches shorter than the quarter wave. Tuning can also be performed with discrete capacitors. The tuning is relatively difficult and it increases the production costs of the directional coupler. In addition, its losses increase compared to the basic structure.

Figure 3A:
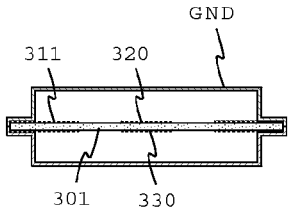
Figure 3B:
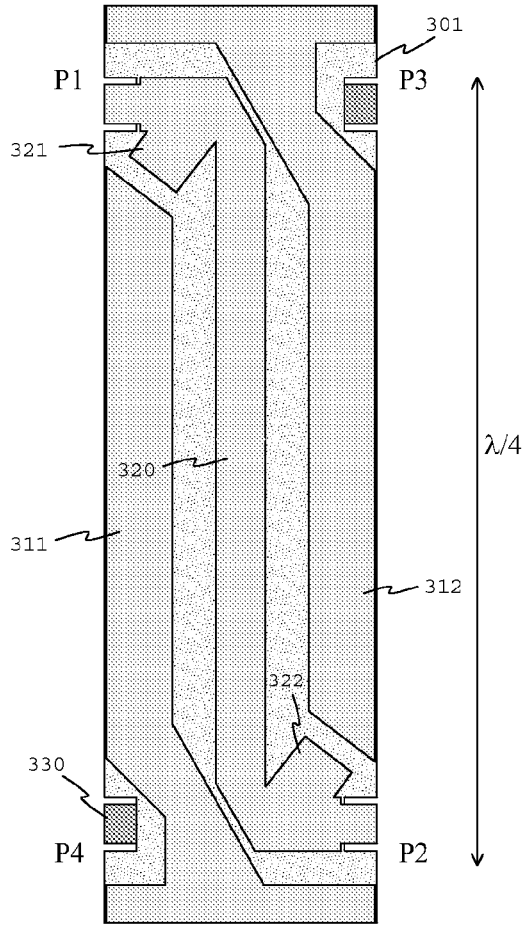
PRIOR ART Fig. 3b

FIGS. 3*a* and 3*b* show a directional coupler known from publication U.S. Pat. No. 6,822,532 in which the transmission path is mainly air-insulated. The transmission conductor 320 is a conductive strip on the upper surface of a relatively thin dielectric substrate 301, and the signal ground i.e. the ground plane GND is a rigid metal plate being located at a certain distance from the substrate. In this description and claims, this kind of transmission line is called a "suspended stripline". FIG. 3*a* shows the cross section from the middle of the structure. It appears therefrom that the structure has two suspended striplines symmetrically: on the lower surface of the substrate 301 at the transmission conductor 320 there is a strip conductor 330 functioning as the sensing conductor of the directional coupler, and below the substrate there is a similar ground plane as there is above. The ground planes further constitute side walls for the structure so that a conductive and closed housing is created. In FIG. 3*b* there is a top view of the circuit board constituted by the substrate and the conductive strips. The transmission conductor 320 passes in the middle of the upper surface of the substrate in its longitudinal direction. Close to one end of the board, the transmission conductor turns to the long side of the board constituting the input port P1 of the directional coupler together with the signal ground. Close to the other end of the board, the transmission conductor turns to the opposite long side of the board constituting the output port P2 of the directional coupler together with the signal ground. The distance of the input and output ports is the quarter wavelength. On the upper surface of the substrate, there are also two ground strips 311, 312 so that the transmission conductor passes between them, the strips being connected to the signal ground from their outer edges. At the end on the side of the input port P1, the transmission conductor 320 and the second ground strip 312 are close to each other for some distance. Furthermore, the transmission conductor has a projection 321 towards the first ground strip 311. Correspondingly, at the end on the side of the output port P2, the transmission conductor and the first ground strip 311 are close to each other for some distance, and the transmission conductor has a second projection 322 towards the second ground strip 312. By means of this kind of shaping the capacitance between the transmission conductor and the signal ground is increased at both ends of the transmission conductor so that the velocity difference of the even and odd waveform decreases. Regarding the sensing conductor 330 there is a similar arrangement on the lower surface of the substrate 301. The ends of the sensing conductor constitute with the signal ground the measurement port P3 and the isolated port P4 of the directional coupler.

The costs of the above-described structure are considerably higher than ones of directional couplers of circuit board structure. A disadvantage of all directional couplers using lines of $\lambda/4$ length is that they function satisfactorily only in a relatively narrow frequency range. Furthermore, in many applications, they require an inconveniently large space.

Figure 4:
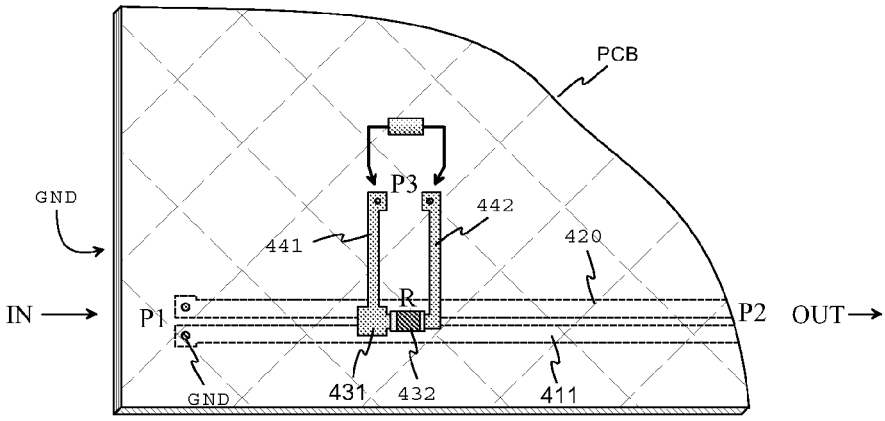
Fig. 4 PRIOR ART

From publication FI 20040450 is known a directional coupler, in which no lines of quarter-wavelength are used, but a relatively small probe positioned in the field of the signal to be measured. The probe includes a resistor and some conductor surface. FIG. 4 shows an example of such a directional coupler constituted on a circuit board. The circuit board PCB is in this example a multi-layer board. In an interlayer of it, there is a straight first conductive strip 420 which is the transmission conductor of the transmission path and, parallel to it, a ground strip 411 belonging to the signal ground. Parallel to the transmission conductor on its other side, there might well pass a second ground strip. In addition to the ground strip, the signal ground comprises the conductive lower surface of the circuit board PCB i.e. a ground plane. On the upper surface of the circuit board on top of the transmission path, there is a chip resistor 432 above the transmission conductor 420 and the ground strip 411. The first end of the resistor is connected to a strip-like first measurement conductor 441 and the second end to a strip-like second measurement conductor 442. The measurement line constituted by the measurement conductors leads to the measurement port P3 of the directional coupler. The resistor 432 functions as the termination resistor of the measurement line and as a part of the probe which senses the strength of the electromagnetic field propagating on the transmission path. The other substantial part of the probe consists of a sensing conductor 431 which is an extension of the first measurement conductor next to the resistor, on the side of the input port P1 of the directional coupler of the resistor. The directivity is based on such an asymmetric structure of the probe. With the structure of FIG. 3, good directivity is obtained in a large frequency range.

The object of the invention is to implement a directional coupler with a novel and advantageous way. The directional coupler according to the invention is characterised by what is presented in the independent claim 1. Some advantageous embodiments of the invention are described in the other claims.

The basic idea of the invention is the following: The structure of the directional coupler comprises a dielectric substrate on top of a metal plate functioning as the ground plane. The transmission path is a suspended stripline so that there is a recess on the ground plane below the transmission conductor being on the surface of the substrate. The sensing conductor is a very small-sized conductive strip on the surface of the substrate or on its layer. It is connected from its head end to the measurement port and from its tail end via a termination resistor to a small ground strip. The ground strip is next to the sensing conductor on the side of the output port of the directional coupler. With such an asymmetric structure, some directivity is obtained despite the small size of the sensing conductor. Also below the sensing conductor there is a recess on the ground plane which recess joins to the recess below the transmission conductor. By dimensioning the recess below the sensing conductor suitably, the velocities of the even and odd waveform occurring in the line constituted by it and the ground plane are obtained the same and thus the directivity can be improved.

An advantage of the invention is that a directional coupler with good directivity can be implemented very small-sized. This means a considerable space-saving on the circuit board on which the conductive strips of the directional coupler reside. A further advantage of the invention is that the losses of the directional coupler according to it are relatively low because of the suspended stripline used as the transmission path. Related to this, ordinary circuit board material affordable from the viewpoint of costs can be used as the substrate. From this further follows that an advantageous circuit board from the viewpoint of production costs and electrical characteristics can be implemented, which board has in addition to the directional coupler also other parts of radio-frequency circuits. An additional advantage of the invention is that the directional coupler according to it does not require tuning in the production from which follow considerable cost-savings and increasing reliability.

Figure 6:
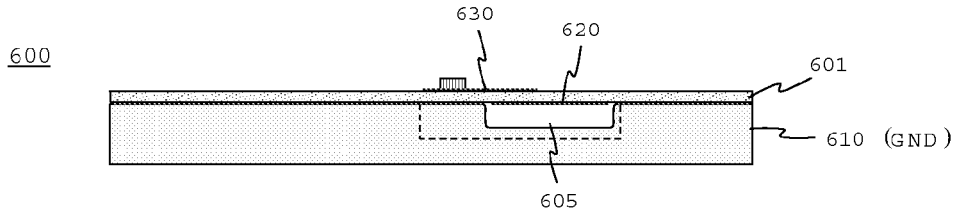
Figure 7:
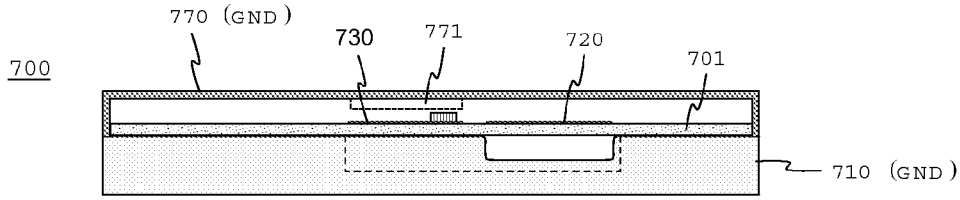
Figure 8:
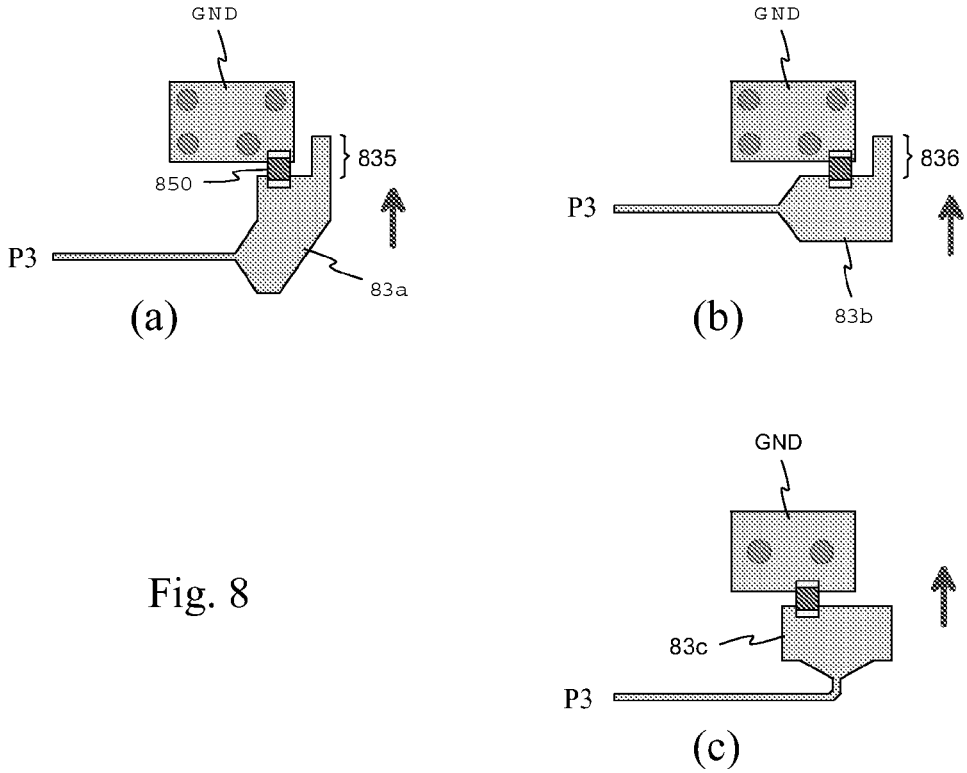
Figure 9:
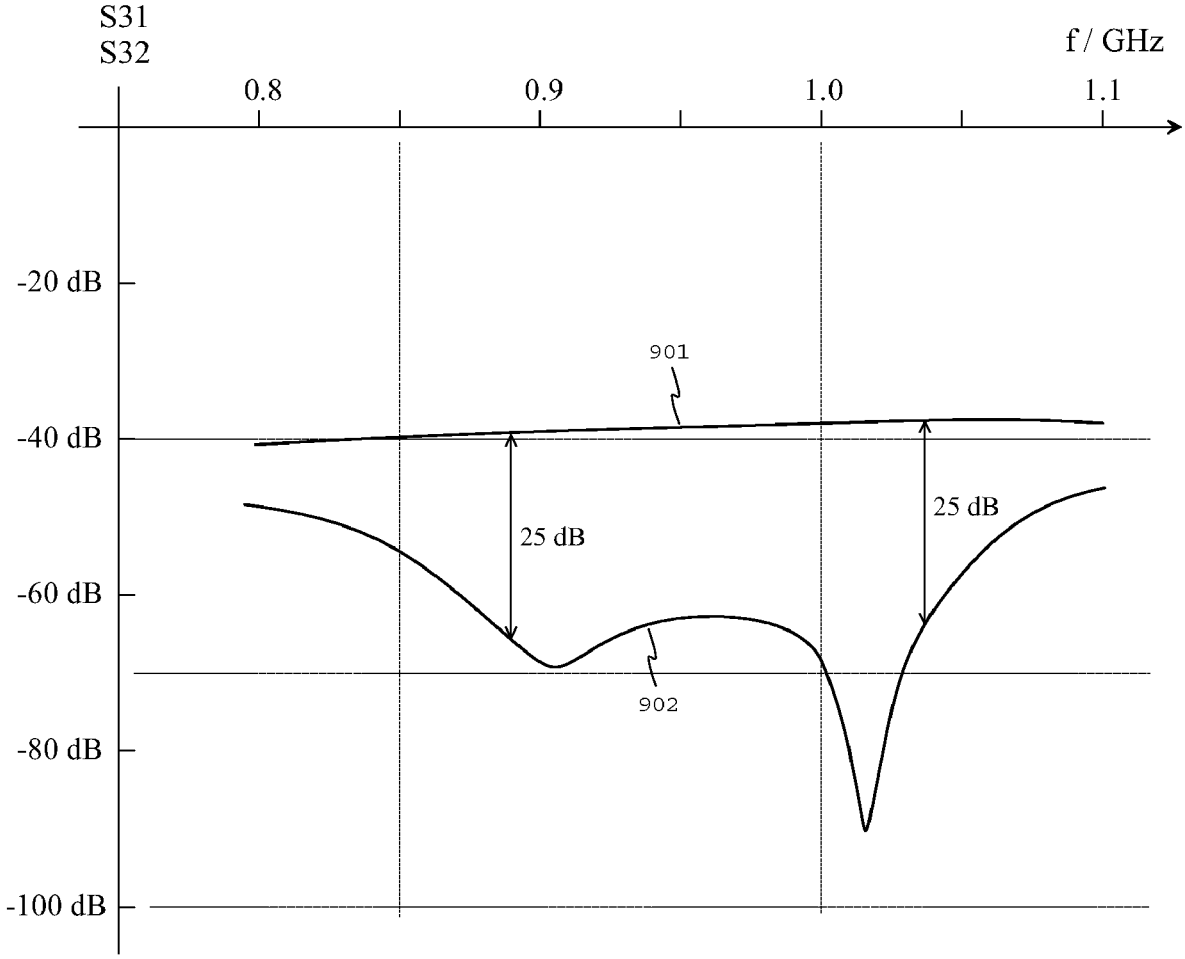

The invention will now be described in detail. The description refers to the accompanying drawings in which FIG. 1 shows an example of a directional coupler according to prior art, FIG. 2 shows an example of the characteristics of a directional coupler according to prior art, FIGS. 3*a,b* show a second example of a directional coupler according to prior art, FIG. 4 shows a third example of a directional coupler according to prior art, FIGS. 5*a-c* show an example of a directional coupler according to the invention, FIG. 6 shows a second example of a directional coupler according to the invention, FIG. 7 shows a third example of a directional coupler according to the invention, FIG. 8 shows more examples of the shaping of the sensing conductor in a directional coupler according to the invention, and FIG. 9 shows an example of the characteristics of a directional coupler according to the invention.

FIGS. 1-4 were already described in connection with the description of prior art.

Figure 5A:
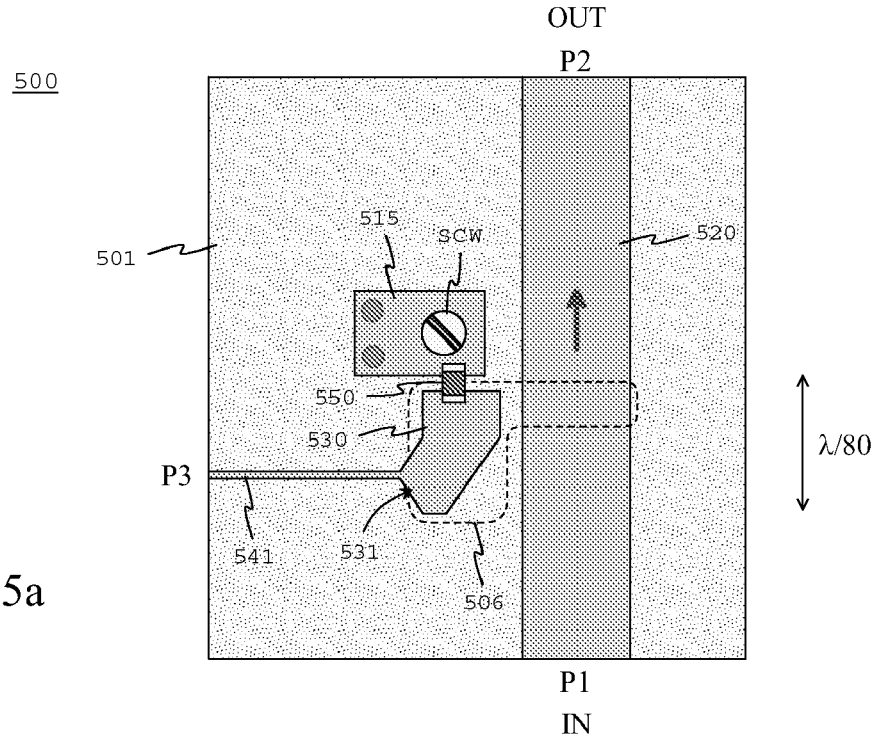
Figure 5B:
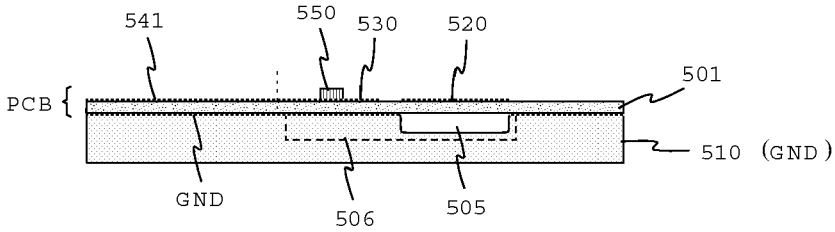
Figure 5C:
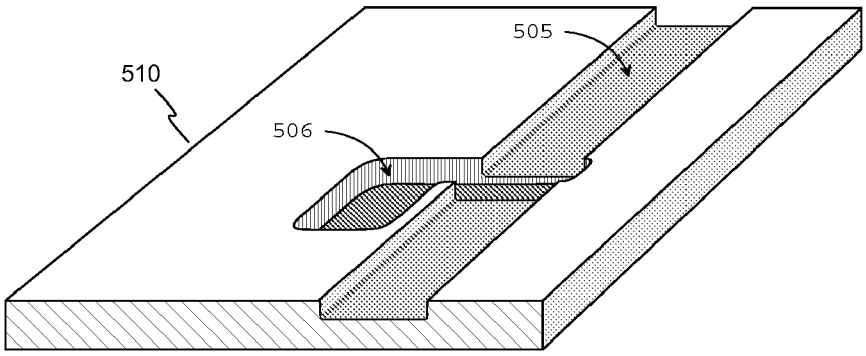

FIGS. 5*a-c* show an example of a directional coupler according to the invention. In FIG. 5*a* the coupler is seen from above, in FIG. 5*b* from the side of the input port and in FIG. 5*c* there is, as perspective drawing, only the ground plane of the directional coupler according to FIGS. 5*a* and 5*b*. The directional coupler 500 comprises a relatively massive ground plane 510 and on top of this a dielectric substrate 501. In this example, the transmission conductor 520 and the sensing conductor 530 of the directional coupler are conductive strips on the upper surface of the substrate. On the upper surface of the substrate, there is also a ground strip 515. The lower surface of the substrate in this example has been largely coated with a conductor which is in contact with the ground plane and thus is a part of the signal ground GND. It is wise to make this kind of coating to at least the fastening points of the substrate for improving the grounding. Also on the upper surface of the substrate, there can be some signal ground in addition to the aforementioned ground strip. The substrate with its conductors and components connected to it constitutes a circuit board PCB. On the ground plane below the transmission conductor 520 there is a trough-like recess 505 for its whole length. From this follows that the transmission path is largely air-insulated and thus its type is a suspended stripline. The impedance of the transmission path is set as desired by choosing the depth of the recess suitably.

The sensing conductor 530 is very small. Its electrical length is e.g. only 1/80 of wavelength λ. Such a length is only a tenth of length λ/8 which is used some in directional couplers. In this example, the sensing conductor is next to the transmission conductor the distance between them being e.g. 1/400 of the wavelength. The sensing conductor is connected from its head end to the measurement port P3 with a measurement conductor 541 perpendicular in respect of the transmission conductor, which measurement conductor is of the same conductive strip as the sensing conductor. Seen from the measurement port, at the head end of the sensing conductor there is an evenly widening portion 531 for improving the impedance matching of the whole measurement arrangement. The tail end of the sensing conductor 530 is connected to one end of the termination resistor 550. The "tail end" means that side of the sensing conductor which is closest to the output port. When the widening head end of the sensing conductor is taken into account, the sensing conductor makes a bend of about 90 degrees following its centre line, the tail end being parallel to the transmission path. The second end of the resistor 550 is, in turn, connected to said ground strip 515. The size of the ground strip in this example is of the same order as the one of the sensing conductor. In this example, it has been connected solidly to the ground plane with a fastening screw SCW of the whole circuit board PCB, and additionally there are vias from the ground strip to the conductive coating of the lower surface of the substrate. The ground strip 515 is located right next to the sensing conductor on the side of the output port P2 of the directional coupler. By means of this kind of an asymmetric structure in respect of the normal of the transmission path, some directivity is obtained despite the small size of the sensing conductor.

Also below the sensing conductor 530 there is a recess on the ground plane 510. This recess 506 joins in this example the recess 505 below the transmission conductor. By dimensioning the width and depth of the recess below the sensing conductor suitably, the velocities of the even and odd waveform occurring in the line constituted by it and the ground plane are obtained the same and thus directivity can be improved. For example, the optimum depth of the recess 506 in a directional coupler functioning in the frequency range 0.9 GHz is of the order of 5 mm.

FIG. 6 shows a second example of a directional coupler according to the invention. Of its basic structure, the directional coupler 600 is similar to the above-described directional coupler 500. The difference is that the transmission conductor 620 is now on the lower surface of the substrate 601 at the air insulation of the suspended stripline, and the sensing conductor 630 on the upper surface of the substrate is now partly above the transmission conductor. Such a location changes the coupling between the transmission conductor and the sensing conductor and thus the characteristics of the directional coupler. The sensing conductor can naturally be entirely above the transmission conductor.

FIG. 7 shows a third example of a directional coupler according to the invention. Of its basic structure, the directional coupler 700 is similar to the directional couplers presented in FIGS. 5*a-c* and 6. The difference is that the directional coupler now also comprises a metal lid 770 above the circuit board. The lid bends from its edges against the ground plane 710 or the ground on the upper surface of the circuit board so that it is a part of the signal ground GND. Such a lid functions as a shield against external interference fields and, on the other hand, naturally affects the impedance of the transmission lines belonging to the directional coupler. In addition, it affects the velocities of the even and odd waveform occurring in the line constituted by the sensing conductor and the ground plane. Above was mentioned arranging these velocities equal by means of the recess below the sensing conductor. For the same reason the lid can include a suitably designed conductive projection 771 at the sensing conductor.

FIG. 8 shows more examples of the shaping of the sensing conductor in a directional coupler according to the invention. Sub-figure (a) shows a sensing conductor 83*a*, a ground strip GND and a termination resistor 850 connected between them. The transmission direction of the signal to be measured marked with a grey arrow is such that the ground strip is located on the side of the directional coupler's output port in respect of the sensing conductor. The sensing conductor is similar by shape as in FIG. 5*a* with the distinction that it further comprises a projection 835 parallel to the transmission path as a continuation of its tail end. With such a projection, the coupling between the transmission and sensing conductor can be changed and thus the directional coupler tuned. In sub-figure (b) there is a similar tuning projection 836 in the sensing conductor 83*b* as in the sensing conductor shown in sub-figure (a). The difference to this is that the sensing conductor 83*b* is, following its centre line, substantially perpendicular to the transmission path, excluding the projection 836. Thus, this sensing conductor does not have, with aforementioned criteria, a portion parallel to the transmission path. In sub-figure (c), in turn, the sensing conductor 83*c* is, following its centre line, entirely parallel to the transmission path, including the widening portion.

FIG. 9 shows an example of the characteristics of a directional coupler according to the invention. Curve 901 shows the change of the signal level in the measurement port in proportion to the level of a forward signal, and curve 902 shows the change of the signal level in the measurement port in proportion to the level of a reverse signal with the same level. The curves are measured from a directional coupler according to FIGS. 5*a-c*, intended for a device functioning in the GSM900 system. Curve 901 corresponds to curve 201 in FIG. 2, and curve 902 curve 202 in FIG. 2. The difference of coefficients expressed in decibels then indicates the value of directivity. The curves indicate that directivity is at least 25 dB in frequency range 0.89-1.04 GHz, which is 16% as a relative value. In FIG. 2, such bandwidth is obtained only with directivity of about 15 dB. The improvement compared to the prior art shown in FIG. 2 is thus very notable despite the fact that the directional coupler is much smaller.

In this description and patent claims, prefixes "lower" and "upper" and epithets "below", "above" and "a top view" refer to the position of the directional coupler in which the circuit board belonging to it is horizontal and the ground plane the undermost. The use position of the directional coupler can naturally be whichever.

Above is described the structure of the directional coupler according to the invention. Its implementation can differ in its details from the ones described. The substrate can be e.g. multi-layered, whereby at least one of the conductive strips constituted by the transmission conductor, the sensing conductor and the ground strip is inside the substrate. The inventive idea can be applied in different ways within the limitations set by the independent claim 1.

The invention claimed is:

1. A directional coupler which comprises a dielectric substrate on top of a metal plate functioning as a ground plane, an input port, an output port and a transmission path between them, which path is a suspended stripline so that there is a recess on the ground plane below a transmission conductor on a surface of the substrate, a sensing conductor, which is a conductive strip on the surface of the substrate, a head end of the sensing conductor being connected to a measurement port of the directional coupler and a tail end being connected to a termination resistor, wherein the sensing conductor is substantially smaller than an eighth of a wavelength, the directional coupler further comprises a ground strip connected to the ground plane to obtain directivity, which ground strip is located next to the sensing conductor on the side of the output port, and to which ground strip one end of said termination resistor has been connected, and there is a recess on the ground plane also below the sensing conductor to improve directivity.

2. A directional coupler according to claim 1, wherein the sensing conductor is next to the transmission conductor on an upper surface of the substrate.

3. A directional coupler according to claim 1, wherein the sensing conductor is on an upper surface of the substrate, the transmission conductor is on a lower surface of the substrate and is air insulated from the substrate as suspended stripline, and the sensing conductor is at least partly above the transmission conductor.

4. A directional coupler according to claim 1, wherein it further comprises a metal lid above the substrate in galvanic connection with a signal ground.

5. A directional coupler according to claim 4, wherein said lid comprises a conductive projection located above the sensing conductor so as to arrange equal velocities of even and odd waveforms in the line constituted by the sensing conductor and the ground plane.

6. A directional coupler according to claim 1, wherein the recess on the ground plane below the sensing conductor joins the recess on the ground plane below the transmission conductor.

7. A directional coupler according to claim 1, herein, seen from the measurement port, at the head end of the sensing conductor there is an evenly widening portion to improve the impedance matching of the whole measurement arrangement of the forward signal.

8. A directional coupler according to claim 7, wherein the sensing conductor makes a bend of around 90 degrees following its centre line, the tail end being parallel to the transmission path.

9. A directional coupler according to claim 7, wherein the sensing conductor is, following its centre line, entirely parallel to the transmission path.

10. A directional coupler according to claim 7, wherein as a tail-end continuation of the sensing conductor there is a projection parallel to the transmission path so as to tune the directional coupler.

11. A directional coupler according to claim 10, wherein the sensing conductor is, following its centre line, substantially perpendicular to the transmission path, excluding said projection.

12. A directional coupler according to claim 1, wherein the lower surface of the substrate has been coated to a great extent with a conductor which is in contact with the ground plane and thus is a part of the signal ground.

13. A directional coupler according to claim 1, wherein the substrate is multi-layered and at least one of the conductive strips constituted by the transmission conductor, the sensing conductor and the ground strip is inside the substrate.

* * * * *